United States Patent [19]

Potthast, Sr.

[11] Patent Number: 4,790,533

[45] Date of Patent: Dec. 13, 1988

[54] BASEBALL BASE SETTING APPARATUS

[76] Inventor: Clarence H. Potthast, Sr., R.R. #1, Box 231, Pocahontas,, Ill. 62275

[21] Appl. No.: 178,843

[22] Filed: Apr. 1, 1988

Related U.S. Application Data

[63] Continuation of Ser. No. 858,195, May 1, 1986, abandoned.

[51] Int. Cl.[4] ..... A63B 71/00

[52] U.S. Cl. ..... 273/25; 173/90; 173/91

[58] Field of Search ..... 273/25; 173/170, 126, 173/90, 91, 128, 130, 131

[56] References Cited

U.S. PATENT DOCUMENTS

| | | | |
|---|---|---|---|
| 52,799 | 2/1866 | Winter | 173/90 |
| 267,605 | 11/1882 | Sherman | 173/126 |
| 716,274 | 12/1902 | Peirce, Jr. | 273/25 |
| 875,940 | 1/1908 | Mason | 173/131 |
| 1,646,039 | 10/1927 | Murton | 173/126 |
| 2,629,985 | 3/1953 | McDowell | 173/131 |
| 3,050,095 | 8/1962 | Prather | 173/126 |
| 3,126,203 | 3/1964 | Bourret | 273/25 |
| 3,508,747 | 4/1970 | Orsatti | 273/25 |
| 3,712,389 | 1/1973 | Smoak | 173/126 |
| 3,823,785 | 7/1974 | Toliver | 173/90 |
| 4,162,789 | 7/1979 | Hollaway | 273/25 |
| 4,218,059 | 8/1980 | Elden | 273/25 |
| 4,252,472 | 2/1981 | Moraly | 273/126 |
| 4,261,424 | 4/1981 | Gonterman | 173/91 |
| 4,405,005 | 9/1983 | Zanker | 173/128 |

*Primary Examiner*—Richard C. Pinkham
*Assistant Examiner*—T. Brown
*Attorney, Agent, or Firm*—Haverstock, Garrett & Roberts

[57] ABSTRACT

Apparatus for setting bases at selected locations on a baseball or softball field, comprising a base anchor socket or peg member designed to be complementarily engageable with stud members associated with or forming a part of the undersides of bases, a base anchor setting assembly including an elongated shank portion with an associated force transferring portion, which base anchor setting assembly is adapted to be complementarily engageable with the base anchor socket member, and a driving member complementarily engageable with the base anchor setting assembly and operable when so engaged and when the base anchor setting assembly and base anchor socket member are also engaged with one another to effect the repetitive application of force to and through the force transferring portion to cause the base anchor socket member to be driven into the ground at a selected location.

11 Claims, 2 Drawing Sheets

BASEBALL BASE SETTING APPARATUS

This is a continuation of co-pending application Ser. No. 858,195, filed on May 1, 1986, abandoned.

BACKGROUND OF THE INVENTION

The present invention relates to a means and method for positioning and installing bases at various locations on a baseball or softball field, and, more specifically, to a base anchor peg and setting tool therefor and means of use thereof.

Due to rising property costs, only a limited amount of land is being newly made available for leisure activities such as baseball and softball, and many existing baseball and softball fields are being converted to other uses. Consequently, the need exists to efficiently utilize those remaining land areas that are presently devoted to baseball and softball fields. Since the ages and skill levels of the various individuals desiring to use any given baseball or softball field may vary over a wide range, the efficient utilization of such field requires that the field be adaptable for different field layouts, including different separations of bases, for different groups of users. In many sports complexes, as many as seven (7) different base positioning arrangements per field may be required in order to properly and effectively accommodate the different ages and skill levels of the players who use such field.

In light of the obvious need to be able to modify field set-ups for different levels of play, to be able to make such modifications by movement of the bases, and to be able to effect such modifications in a minimal amount of time, it has been found advisable and desirable to have permanent or semi-permanent base positioning means installed at various locations on a field. Such installations provide a groundskeeper with the ability to quickly and easily set bases at initial field positions appropriate to a first condition of play, and to subsequently quickly and easily remove such bases and reset them at other positions appropriate to different conditions of play. One such base positioning means that has gained relatively wide acceptance includes a base anchoring device, such as a peg or socket member, embedded in concrete which is set into the ground below the surface thereof, which peg or socket member is complementarily engageable with stud members associated with or forming a part of the undersides of the bases. In practice, the installation of such a base positioning means is typically effected, as described in U.S. Pat. No. 3,508,747, by digging a hole at a desired base location, filling the hole to just below ground level with concrete, and inserting a base peg member into the concrete so that the concrete will harden and hold such peg member. While the noted base positioning means has been found to work reasonably well, certain difficulties and disadvantages attendant to the use thereof have limited the value thereof. In this regard, it has been found that a great deal of time is required to install a plurality of such base positioning means at desired locations, especially when a field must accommodate a number of different field set-ups. Also, the proper alignment of the base anchoring device within the concrete as it hardens is somewhat difficult to maintain, the field must be taken out of use for a significant amount of time to permit the concrete to harden, removal and resetting of the base positioning installation is difficult and time consuming if the initial set-up is erroneous or needs to be changed or removed for other reasons, and the installation and removal procedures often mar the ground around the installation site, thereby interfering with normal field usage and often necessitating additional ground maintenance to return the field to playing condition.

SUMMARY OF THE INVENTION

The present invention is designed to obviate and overcome many of the disadvantages and shortcomings experienced with the base setting means discussed hereinbefore and with other base setting means used in the past, and to provide a base setting means which can be easily utilized to install base anchoring means at desired locations on a baseball or softball field. Briefly such base setting means comprises a base anchor socket or peg member designed to be complementarily engageable with stud members associated with or forming a part of the undersides of bases, a base anchor setting means including an elongated shank portion with an associated force transferring means, which base anchor setting means is adapted to be complementarily engageable with the base anchor socket member, and a driving means complementarily engageable with the base anchor setting means and operable when so engaged and when the base anchor setting means and base anchor socket member are also engaged with one another to effect the repetitive application of force to and through the force transferring means to cause the base anchor socket member to be driven into the ground at a selected location. In its preferred form, the base anchor socket member includes an upper portion of substantially rectangular cross-section with a socket of substantially rectangular cross-section formed therein and a lower portion depending from said upper portion and tapering to a thin blade edge. The base anchor setting means preferably is formed from separate elongated upper and lower end portions, each of substantially rectangular cross-section, joined to one another in an end-to-end relationship by a mating collar whose outermost surface projects beyond the outer circumferences of the elongated upper and lower end portions, with the lower end portion being dimensioned substantially similarly to the stud members associated with or forming a part of the undersides of the bases, whereby the lower end portion can be slidingly inserted into and engaged by the socket of the base anchor socket member. The driving means is preferably a tubular drive member of substantially rectangular cross-section dimensioned to be slidably telescopingly mounted upon and about the upper end portion of the base anchor setting means and reciprocally movable thereupon to be brought into contact with the mating collar to effect the application of force thereto and therethrough to the base anchor socket member. Optionally, the tubular drive member may be closed at its upper end so that the drive member can be removed from the upper end portion of the base anchor setting means, reversed, and utilized as a tamper for packing, leveling, and smoothing the playing surface around the site at which the base anchor socket member is installed. With such base setting means, a plurality of base anchor socket members can be quickly and easily installed at desired locations on a baseball or softball field, and a groundskeeper can thereafter readily anchor the bases at the sites of any of the installed base anchor socket members and quickly and easily reposition such bases to the sites of other installed base anchor socket members as the need arises. In the event of a misplacement of a base anchor socket member, such socket member can be easily removed and repositioned, and all such setting, removal, repositioning, and resetting can be accomplished with a minimal amount of time and effort, without any significant damage to the playing surface of the field, and without any necessity for removing the field from play for an extended period to permit the installation or removal of the base anchoring means.

OBJECTS OF THE INVENTION

Accordingly, an important object is to provide a means and method for setting bases quickly, efficiently, and securely.

Another object of the present invention is to provide a means and method for setting bases, which means and method permit fast and reliable alignment of the bases with respect to home plate and one another.

A still further object of the present invention is to provide a novel tool for setting and removing base anchor socket members.

Another object of the present invention is to provide a base anchoring system that can be utilized uniformly in both professional and amateur sports.

Yet another object of the present invention is to provide a base anchoring installation the use of means which imparts only a minimal amount of damage to a playing surface.

A still further object of the present invention is to provide a tool for setting and removing base anchor pegs which can also be used as a tamping device.

BRIEF DESCRIPTION OF THE DRAWINGS

A more complete appreciation of the invention and many of the attendant advantages thereof will be readily obtained as the same become better understood by reference to the following detailed description when considered in connection with the accompany drawings, wherein.

DETAILED DESCRIPTION OF THE PREFERRED EMBODIMENT

Figure 1:
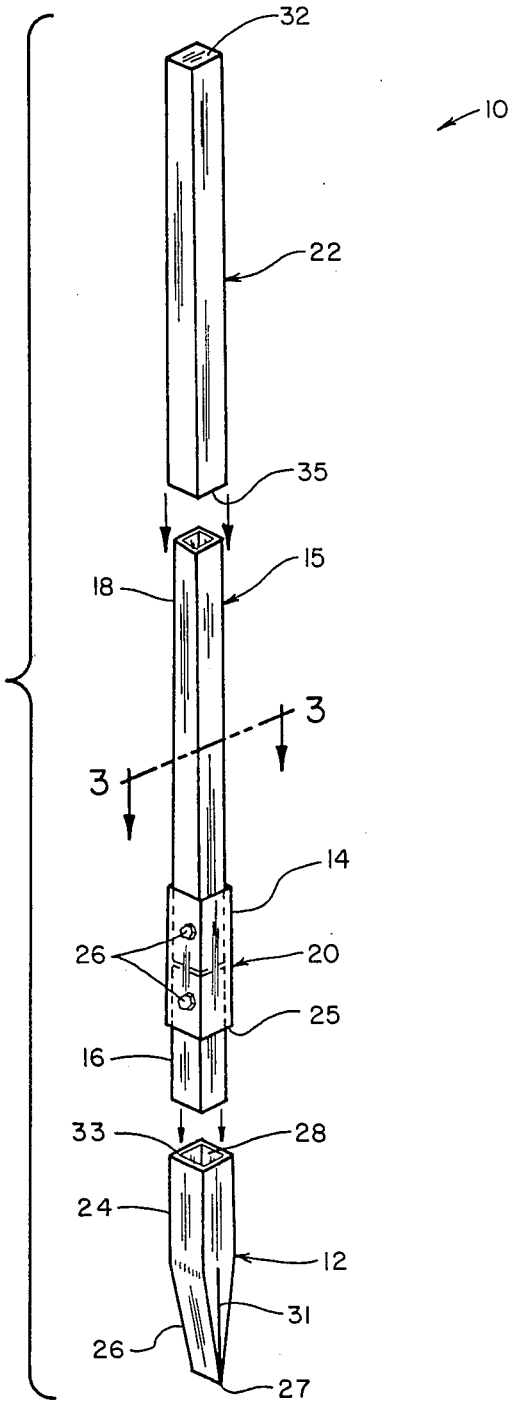
FIG. 1 is a partially exploded view of a preferred embodiment of the present invention, depicting how the various components of the invention may be engageably assembled with one another.

Referring now to the drawings, wherein like numbers refer to like items, number 10 in FIG. 1 identifies a base setting means constructed in accordance with the present invention. Such means comprises a base anchor socket or peg member 12, a base anchor setting means 14, including an elongated shank portion 15 and force transferring means 20, and driving means 22 for applying a force to the force transferring means 20.

The base anchor socket member 12 may take a variety of forms. In the particular embodiment depicted in FIG. 1 the base anchor socket member includes an upper portion 24 of substantially rectangular cross-section and a wedge-shaped lower portion 26 depending from said upper portion 24 and tapering to a thin blade edge 27. The tapering of lower end 26 between upper portion 24 and blade edge 27 is intended to facilitate the penetration of packed earth by the socket member during an installation procedure. Upper portion 24 has a socket 28 of substantially rectangular cross-section formed therein, which socket is adapted to receive a rectangular stud such as might be associated with the underside of a baseball or softball base. The rectangular cross-sectional forms of the socket 28 and of the upper portion 24 of the base anchor socket member 12 are intended to facilitate the rapid alignment of the socket member with respect to home plate and other base anchor socket members during an installation procedure. Such rectangular cross-sectional form of the upper portion 24 of the base anchor socket member 12 also functions after the socket member has been driven into the ground during an installation procedure to prevent rotational movement of the installed base anchor socket member 12 and any base whose stud may be engageably inserted in the socket 28 thereof. Such stability is important when one considers the amount of force that a base and its anchoring device must absorb when a player slides into the base. When properly installed, such base anchor socket member 12 thus provides, due in part to its advantageous design, a stable, nearly permanent, base anchoring device.

Figure 2:
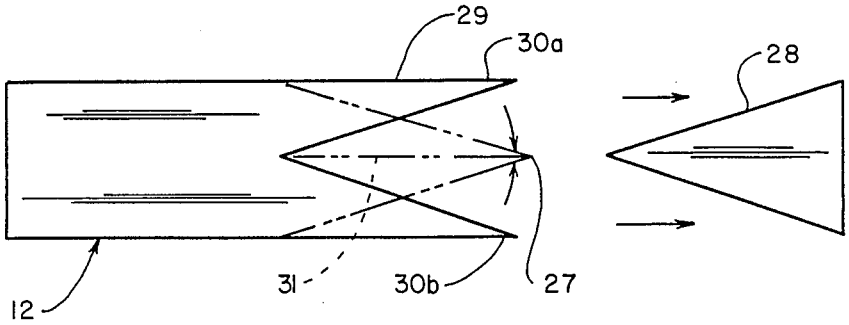
FIG. 2 is an illustration of the base anchor socket member which depicts the manner in which such socket member may be formed from rectangular tubing.
Figure 3:
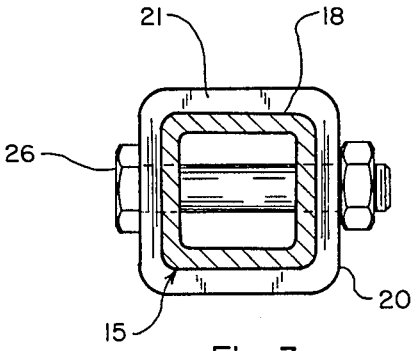
FIG. 3 is a cross-sectional view of the base anchor setting means taken along line 3—3 of FIG. 1; and, FIG. 4 is an illustration of a plug that may be used to close the opening in the base anchor socket member.
Figure 4:
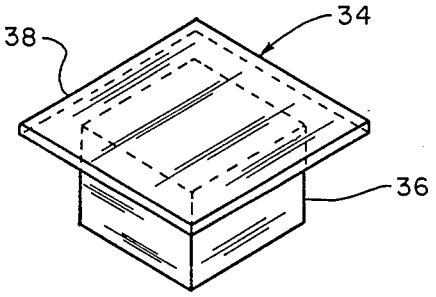

In practice, base anchor socket member 12 may be readily constructed, as depicted in FIG. 2, from a length of rectangular tubing 29 from which a wedge-shaped portion 28 is cut and removed. When the wedge-shaped portion 28 is removed, the spaced end tangs 30*a* and 30*b* of tubing 29 are pressed towards one another and joined, such as by a weld joint, to define blade edge 27. The space or slit 31 between and along the sides of the joined end tangs 30*a* and 30*b* is preferably left at least partially unsealed to act as a drainage outlet for any water or other moisture that might collect in socket member 12, especially when such socket member is installed in the ground.

The base anchor setting means may also take a variety of forms. However, in the preferred embodiment depicted in FIG. 1, base anchor setting means 14 includes an elongated shank portion 15 having a lower portion 16 dimensioned similarly to the stud members associated with or forming a part of the underside of the bases, an upper portion 18 of substantially rectangular cross-section, and a force transferring means in the form of a mating collar 20 disposed intermediately along shank portion 15 to join lower portion 16 and upper portion 18 to one another in end-to-end alignment. As will be discussed more fully hereinafter, the force transferring means acts to receive forces applied thereto and to transmit such forces to the base anchor socket member 12 when the lower portion 16 of the base setting means 14 is slidingly inserted into and engaged in socket 28 of the upper portion 24 of such socket member 12.

As has been noted, in the preferred embodiment of FIG. 1 the force transferring means takes the form of a mating collar 20 disposed intermediately along the elongated shank portion 15 of base anchor setting means 14. Such collar 20 includes an upper surface 21 that projects beyond the outer circumference of upper portion 18 of shank portion 15 and a lower surface 25 that projects beyond the outer circumference of lower portion 16 of shank portion 15. Such lower surface 25 is designed to be brought into contact with the upper edge 33 of the upper tubular portion 24 of the base anchor socket member 12 when the lower section 16 of the base anchor setting means 14 is inserted within the socket 28 of base anchor socket member 12. The application of a force to the upper surface 21 of mating collar 20 at the time when the lower surface 25 thereof is in contact with upper edge 33 of the base anchor socket member 12 will result in the transmission of such force to the base anchor socket member 12 to cause the ground penetrating blade edge 27 to be driven into the ground or other surface upon which it is resting. Although such collar 20 is shown in FIGS. 1 and 2 as being attached to the upper and lower end portions 16 and 18 of base anchor setting means 14 by means of nut and bolt assemblies 26, it will be understood that many other means of securing such collar 20 along elongated shank portion 15 could be equally as well employed.

It will be readily apparent that the forms of the force transferring means and of the driving means employed in the present invention are interrelated and interdependent. A variation in form of one of such means may require a corresponding variation in form of the other of such means. In the FIG. 1 embodiment, wherein the force transferring means takes the form of a mating collar 20 disposed intermediately along the elongated shank portion 15 of base anchor setting means 14, the driving means 22 takes the form of a tubular member of rectangular cross-section, dimensioned to be slidably telescopingly mounted upon and around the upper portion 18 of base anchor setting means 14 and to thereafter be reciprocally slideable thereupon to bring the lower edge 35 thereof into contact with the upper surface 21 of mating collar 20. The forceful sliding of the driving means 22 downward about the upper section 18 of base anchor setting means 14 when the lower portion 16 of the base anchor setting means 14 is engaged within socket 28 of the base anchor socket means 12, with the lower surface 25 of mating collar 20 in contact with upper edge 33 of base anchor socket means 12, causes lower edge 35 of such driving means 22 to be brought into driving contact with the upper surface 21 of the mating collar 20, thereby effecting the application of a force to and through such mating collar 20 to the base anchor socket means 12. By repeated applications of such a force the base anchor socket means can thus be driven into the ground at a selected location on a baseball or softball field.

Once the base anchor socket means 12 has been driven into the ground at a selected location, installation of a base thereat is easily accomplished. The lower portion 16 of the base anchor setting means 14 is simply withdrawn from socket 28 of the base anchor socket means 12 and the stud member associated with or forming a part of the underside of the base inserted in such socket 28 in place thereof.

In the preferred embodiment depicted in FIG. 1, the upper and lower portions of the base anchor setting means are depicted as separate tubular elements of rectangular cross-section and the mating collar is depicted as an external tubular sleeve into which the upper and lower portions of the base anchor setting means are inserted and to which such sections are attached. It should be appreciated, however, that with a driving means 22 of the type depicted in FIG. 1, the base anchor setting means could alternatively take the form of an elongated one-piece construction with a projecting flange disposed intermediately therealong or of a two-piece construction including an elongated bar-type member with a drive collar member mounted at an intermediate position therealong. While it is preferred that the upper portion of the anchor setting means be of rectangular cross-section to facilitate alignment of the base anchor socket means at the time such socket means is set into the playing field, it should be recognized that other cross-sectional configurations are nevertheless possible and could be employed.

In an alternate embodiment of the invention, the base anchor setting means may comprise an elongated tubular member having an open top end and a closed lower end, with a stud portion extending downwardly from the closed lower end, such stud portion being dimensioned substantially similarly to the stud members associated with or forming a part of the undersides of the bases and being adapted to be engageably inserted into the socket 28 of the base anchor socket means 12 depicted in FIG. 1. In such an embodiment, the driving means could take the form of a drive rod or a drive tube member closed on the lower end, which rod or tube is dimensioned to be slidably telescopingly inserted within the elongated tubular member of the base anchor setting means and to thereafter be slideable therewithin to bring the bottom end of the rod or the closed lower end of the tube member into contact with the closed end of the elongated tubular member of the base anchor setting means. If the stud portion were engageably inserted into socket 28 of the base anchor socket means 12 a user could then forcefully slide the drive rod or drive tube member downwardly in the elongated tubular member to cause the bottom end of the drive rod or the closed lower end of the drive tube member to be brought into driving contact with the closed lower end of the elongated tubular member to thereby effect the transmission of such applied force to the base anchor socket means to drive such socket means into the ground.

Those skilled in the art will recognize that other embodiments of the present invention are also possible and contemplated, many of which may include components thereof whose configurations differ in some manner from the embodiments discussed hereinbefore, but which embodiments nevertheless include the basic components of the present invention and fall within the spirit and scope thereof. In addition, such embodiments may incorporate a variety of optional features which provide a user with still further advantages. By way of example, a leveling means may optionally be attached to the base anchor setting means to permit a user thereof to be able to readily determine that the base anchor socket means is being properly installed perpendicularly to the ground surface and not at some non-perpendicular inclination. Also, with some embodiments of the invention, it may be desirable to provide a pair of handles on the driving means whereby a person using the driving means may grasp the handles and use them to more forcefully reciprocally slide the driving means relative to the base anchor setting means to cause the base anchor socket member to be driven into the ground. Additionally, as depicted in the preferred embodiment of FIG. 1, the top end 32 of driving means 22 may be closed so that, upon the removal of such driving means 22 from the base anchor setting means 14, driving means 22 can be reversed and used as a tamper for leveling portions of the playing area or filling in holes on the field.

If it is not desired to always have a base installed at the site of an installed base anchor socket means, it is a simple matter to remove the stud member associated with or forming a part of the underside of such base from the installed socket member leaving the socket member in place in the ground. An optional plug 34 can then be easily inserted into socket 28 to prevent dirt or other foreign matter from falling into or being introduced into opening 28. Such plug typically may include a stud portion 36, adapted to be insertable into and engageable with socket 28, topped by a relatively thin cap 38 that is designed to lay substantially flush with the surface of the ground and which overhangs the stud portion 36. When it is desired to reinstall a base at such site, the plug 34 can be easily removed by grasping the edges of the cap and withdrawing the stud portion of the plug 34 from the socket 28, and the stud member associated with or forming a part of the underside of the base can then be reinstalled in such socket.

If a base anchor socket means is improperly installed or if it is ever desired to remove an installed base anchor socket means for any reason, removal of such socket means can be easily accomplished by use of the base anchor setting means of the preferred embodiment. The lower portion 16 of base anchor setting means 14 may be readily inserted into socket 28 of the base anchor socket means 12 and sidewardly force applied to the upper portion 18 of such setting means to loosen the packed earth around the installed base anchor socket means so that such socket means can be pulled out of the ground. Because of the leverage that can be obtained when sidewardly force is applied near the upper end of the base anchor setting means 14 it is generally rather easy to loosen the packed earth sufficiently to permit the withdrawal of the socket means from the loosened earth. In such instances, the tampering capability of the preferred embodiment has been found to be particularly advantageous since the driving means 22 can then be utilized after removal of the socket member to smooth and level the playing surface about the area of removal.

From the foregoing, it will be apparent that there have thus been shown and described a base setting means and method which fulfill the various objects and advantages sought therefor. It will be apparent to those skilled in the art, however, that many changes, modifications, variations, and other uses and applications of the subject base setting means and method are possible and contemplated. All such changes, modifications, variations, and other uses and applications which do not depart from the spirit and scope of the invention are deemed to be covered by the invention, which is limited only by the claims which follow.

What is claimed is:

1. A base setting means for setting at a selected location on a playing field with a defined side line a base which has a stud member of rectangular cross-section associated with the underside thereof a kit of separate components, including a base anchor socket member, a base anchor setting means, and a driving means, assembleably engageable with one another to permit the placement and installation of said base anchor socket member at the selected location for the base;

said base anchor socket member having an upper portion with a socket of rectangular cross-section formed therein and defined by side walls and having a lower portion depending from said upper portion, said lower portion being wedge-shaped with a substantially closed bottom and being tapered to terminate at its lower end in a ground piercing surface, said side walls of said upper portion being of substantially uniform thickness, devoid of guide projections extending outwardly therefrom, and having an upper edge, said socket being of sufficient depth and dimensioned to containably receive therein and to engage the stud member associated with the underside of the base;

said base anchor setting means including an elongated shank portion having upper and lower end portions of rectangular cross-section and an intermediately disposed force transferring means, said lower end portion of said shank portion being dimensioned substantially similarly to the stud member associated with the underside of the base, being shorter than the depth of said socket member, and being adapted to be slidably inserted into said socket of said base anchor socket member in fitted engagement with the side walls of said socket, said force transferring means including a first surface for receiving a force applied thereto and a force transmitting portion, including a force transmitting surface disposed adjacent to and in contact with said upper edge of said side walls of said base socket member when said lower end portion of said shank portion of said base anchor setting means is engageably inserted into said socket of said base anchor socket member, for transmitting a force applied to said first surface from said first surface to said base anchor socket member; and, driving means including an elongated tubular driving member of rectangular cross-section having an upper end and a lower end, said elongated driving member being telescopically slidably complementarily engageable with said upper end portion of said shank portion of said base anchor setting means in fitted engagement therewith and reciprocally slidably movable by a user when so engaged to cause said lower end thereof to impact said first surface of said force transferring means to thereby effect the application of a force to said first surface of said force transferring means, said upper end of said elongated driving member projecting above said upper end portion of said shank member to facilitate the slidable movement of said elongated driving member by the user;

said base anchor socket member being positionable at the selected location for the base with said base anchor setting means engageably inserted into said socket of said base anchor socket member and with said driving member slidably telescopically complementarily engaged with said upper end portion of said shank portion of said base anchor setting means, said base anchor socket member when so engaged being readily visually alignable with a defined side line of the playing field by rotational movement of said driving member by the user and said driving member being reciprocally slidably movable to cause said lower end thereof to impact said first surface of said force transferring means to effect the application of force to said first surface, said force transmitting portion of said force transferring means transmitting the force applied to said first surface from said first surface to said base anchor socket member whereby, by repetitive reciprocal slidable movements of said elongated driving member, said base anchor socket member can be driven into the ground in alignment with a side line at the selected location on the playing field until said upper edge of said base anchor socket member is at least flush with the surface of the playing field;

said base anchor setting means and said driving means being thereafter disengageable from one another and from said installed base anchor socket member to permit the stud member associated with the underside of the base to be engageably inserted into said socket of said base anchor socket member.

2. The base setting means of claim 1 wherein said force transferring means includes a collar assembly mounted at an intermediate location along said elongated shank portion, said collar assembly including said first surface for receiving a force applied thereto and said force transmitting surface disposed oppositely of said first surface, said first surface extending outwardly beyond the outer circumference of said upper portion of said elongated shank portion and said force transmitting surface extending outwardly beyond the outer circumference of said lower portion of said elongated shank portion.

3. The base setting means of claim 2 wherein said upper and lower end portions are separate elongated members and said collar assembly includes means for joining said elongated members in an end-to-end configuration.

4. The base setting means of claim 2 wherein said upper and lower end portions are separate elongated members and said collar assembly includes means for securing such collar assembly to and between said elongated members.

5. The base setting means of claim 2 wherein said upper and lower end portions are separate elongated members and said collar assembly includes a tubular member open at both ends thereof, one of said elongated members inserted into one open end of said tubular member, the other of said elongated members inserted into the other open end of said tubular member, and means securing said collar assembly to each of said inserted elongated members.

6. The base setting means of claim 1 wherein said tubular member is closed at the upper end thereof, said tubular member being removable from said upper end portion of said base anchor setting means and reversible by a user to thereafter be employed as a tamper for tamping the playing field surface.

7. A base setting means for setting at a selected location on a playing field with a defined side line a base which has a stud member of rectangular cross-section associated with the underside thereof, comprising a kit of separate components, including a base anchor peg member, an elongated anchor setting assembly, and an elongated tubular driving member, assembleably engageable with one another to permit the placement and installation of said base anchor peg member at the selected location for the base, said base anchor peg member having a tubular upper portion of rectangular cross-section and a lower portion depending from said upper portion, said upper portion being open at the top end thereof and having an upper edge thereat and side walls defining a socket, said lower portion being wedge-shaped with a substantially closed bottom and tapering to a thin blade edge at its lower end in order to facilitate the penetration of packed earth on a playing field thereby, said side walls being of substantially uniform thickness and devoid of guide projections extending outwardly therefrom, said socket of said open tubular upper portion being of sufficient depth and internally dimensioned to containably receive therein the stud member associated with the underside of the base;

said elongated anchor setting assembly including a lower section of rectangular cross-section and of substantially similar dimensions as the stud member associated with the underside of the base, said lower section being shorter than the depth of said peg member and being adapted to be slidingly inserted into the top end of said tubular upper portion and engaged within said tubular upper portion of said base anchor peg member in fitted engagement with said side walls thereof, an upper section of substantially similar rectangular cross-section as said lower section and disposed end-to-end with said lower section, and a drive collar having a force receiving upper collar surface and a force transferring lower collar surface and being disposed intermediately along said elongated anchor setting assembly, said drive collar projecting beyond the outer circumferences of said upper and lower sections of said anchor setting assembly such that the lower collar surface of said drive collar can be brought into contact with the upper edge of said tubular upper portion of said base anchor peg member when the lower section of said anchor setting assembly is engaged within said socket of said base anchor peg member for transmitting a force applied to said upper collar surface from said upper collar surface to said base anchor peg member;

said elongated tubular driving member having first and second ends and being open at said first end with a driving edge thereat, said driving member being slidably telescopingly insertable from said open first end upon said upper section of said anchor setting assembly and reciprocally slidably movable thereupon by a user to move said driving edge of said driving member into driving contact with the upper collar surface of said drive collar of said anchor setting assembly to apply force thereto and therethrough to said base anchor peg member when said lower section of the anchor setting assembly is inserted into the socket of the base anchor peg member and said lower collar surface of said drive collar means is in contact with said upper edge of said upper tubular portion of said base anchor peg member, said second end of said elongated tubular driving member projecting above said upper section of said elongated anchor setting assembly to facilitate the slidable movement of said elongated driving member by the user;

said base anchor peg member being positionable at the selected location for the base with said lower section of said elongated anchor setting assembly engageably inserted into said socket of said base anchor peg member and with said elongated tubular driving member slidably telescopically complementarily engaged with said upper section of said elongated anchor setting assembly, said base anchor peg member when so engaged being readily visually alignable with a defined side line of the playing field by rotational movement of said elongated tubular driving member by the user and said elongated tubular driving member being reciprocally slidably movable to cause said driving edge thereof to move into driving contact with the upper collar surface of said drive collar to effect the application of force to said upper collar surface, said drive collar transmitting the force applied to said upper collar surface from said upper collar surface to said base anchor peg member whereby, by repetitive reciprocal slidable movements of said elongated driving member, said base anchor peg member can be driven into the ground in alignment with a defined side line at the selected location on the playing field until said upper edge of said base anchor peg member is at least flush with the surface of the playing field;

said elongated anchor setting assembly and said elongated driving member being thereafter disengageable from one another and from the installed base anchor peg member to permit the stud member associated with the underside of the base to be engageably inserted into said socket of said base anchor peg member.

8. The base setting means of claim 7 wherein said lower portion of said base anchor peg member includes a drainage slot.

9. The base setting means of claim 7 wherein said tubular driving member is closed at the upper end thereof, said tubular driving member being removable from said upper end portion of said base anchor setting means and reversible by a user to thereafter be employed as a tamper for tamping the playing field surface.

10. A base setting system for setting at selected locations on a playing field with a defined side line bases each of which has a stud member of rectangular cross-section associated with the underside thereof, comprising:

a kit of separate components, including a plurality of base anchor socket members and an anchor setting tool, said anchor setting tool being individually engageable with each of said base anchor socket members to permit the placement and installation thereof at the selected locations for the bases, each of said base anchor socket members having an upper portion with a socket of rectangular cross-section formed therein and defined by side walls and having a lower portion depending from said upper portion, said lower portion being wedge-shaped with a substantially closed bottom and being tapered to terminate at its lower end in a ground piercing surface, said side walls of said upper portion being of substantially uniform thickness, devoid of guide projections extending outwardly therefrom, and having an upper edge, said socket being of sufficient depth and dimensioned to containably receive therein and to engage a stud member associated with the underside of a base, said anchor setting tool including a base anchor setting assembly and a driving means, said base anchor setting assembly including an elongated shank portion having upper and lower end portions of rectangular cross-section and an intermediately disposed force transferring means, said lower end portion of said shank portion being dimensioned substantially similarly to the stud members associated with the undersides of the bases, being shorter than the depth of said socket member, and being adapted to be slidably inserted into the socket of a selected base anchor socket member in fitted engagement with the side walls of said socket, said force transferring means including a first surface for receiving a force applied thereto and a force transmitting portion, including a force transmitting surface disposed adjacent to and in contact with said upper edge of said side walls of said base anchor socket member when said lower end portion of said shank portion of said base anchor setting means is engageably inserted into said socket of said base anchor socket member, for transmitting a force applied to said first surface from said first surface to the selected base anchor socket member, said driving means including an elongated tubular driving member of rectangular cross-section having an upper end and a lower end, said elongated driving member being telescopically slidably complementarily engageable with said upper end portion of said shank portion of said base anchor setting means in fitted engagement therewith and reciprocally slidably movable by a user when so engaged to cause said lower end thereof to impact said first surface of said force transferring means to thereby effect the application of a force to said first surface of said force transferring means, said upper end of said elongated driving member projecting above said upper end portion of said shank member to facilitate the slidable movement of said elongated driving member by the user, said base anchor socket member being positionable at the selected location for the base with said lower end portion of said shank portion of said base anchor setting assembly engageably inserted into said socket of said base anchor socket member and with said driving member slidably telescopically complementarily engaged with said upper end portion of said shank portion of said base anchor setting assembly, said base anchor socket member when so engaged being readily visually alignable with a defined side line of the playing field by rotational movement of said driving member by the user and said driving member being reciprocally slidably movable to cause said lower end thereof to impact said first surface of said force transferring means to effect the application of force to said first surface, said force transmitting portion of said force transferring means transmitting the force applied to said first surface from said first surface to said base anchor socket member whereby, by repetitive reciprocal slidable movements of said elongated driving member, the selected base anchor socket member can be driven into the ground in alignment with a side line at the selected location on the playing field until said upper edge of said base anchor socket member is at least flush with the surface of the playing field, said base anchor setting assembly and said driving means being thereafter disengageable from one another and from said installed base anchor socket member to permit the stud member associated with the underside of the base to be engageably inserted into said socket of said base anchor socket member.

11. A method for setting a base at a selected location on a playing field having a defined side line, comprising:

supplying a base which has a stud member of rectangular cross-section associated with the underside thereof;

supplying a kit of separate components, including a base anchor socket member and an assembleable anchor setting tool, wherein:

said base anchor socket member has an upper portion with a socket of rectangular cross-section formed therein and defined by side walls and having a lower portion depending from said upper portion, said lower portion being wedge-shaped with a substantially closed bottom and being tapered to terminate at its lower end in a ground piercing surface, said side walls of said upper portion being of substantially uniform thickness, devoid of guide projections extending outwardly therefrom, and having an upper edge, said socket being of sufficient depth and dimensioned to containably receive therein and to engage said stud member associated with the underside of said base, said anchor setting tool includes a base anchor setting assembly and a driving means, said base anchor setting assembly includes an elongated shank portion having upper and lower end portions of rectangular cross-section and an intermediately disposed force transferring means, said lower end portion of said shank portion being dimensioned substantially similarly to said stud member associated with the underside of said base, being shorter than the depth of said socket member, and being adapted to be slidably inserted into said socket of said base anchor socket member in fitted engagement with said side walls of said socket, said force transferring means including a first surface for receiving a force applied thereto and a force transmitting portion, including a force transmitting surface disposed adjacent to and in contact with said upper edge of said side walls of said base anchor socket member when said lower end portion of said shank portion of said base anchor setting means is engageably inserted into said socket of said base anchor socket member, for transmitting the force applied to said first surface from said first surface to said base anchor socket member, and said driving means includes an elongated tubular driving member having an upper end and a lower end, said elongated driving member being telescopically slidably complementarily engageable with said upper end portion of said shank portion of said base anchor setting means in fitted engagement therewith and reciprocally slidably movable by a user when so engaged to cause said lower end thereof to impact said first surface of said force transferring means to thereby effect the application of a force to said first surface of said force transferring means, said upper end of said elongated driving member projecting above said upper end portion of said shank member to facilitate the slidable movement of said elongated driving member by the user;

inserting said lower end portion of said shank portion of said base anchor setting assembly into said socket of said base anchor socket member and slidably engaging said driving means with said upper end portion of said shank portion of said base anchor setting assembly;

positioning said base anchor socket member at a selected location and aligning said base anchor socket member with a defined side line by rotational movement of said driving member;

reciprocally slidably moving said elongated driving member with respect to said upper end portion of said shank portion of said base anchor setting assembly to repetitively apply a force to said first surface of said force transferring means to drive said base anchor socket member into the ground until said upper edge thereof is at least flush with the surface of the playing field;

removing said lower end portion of said shank portion of said base anchor setting assembly from said socket of said base anchor socket member; and inserting the stud member associated with the underside of said base into said socket of said base anchor socket member.

* * * * *

UNITED STATES PATENT OFFICE

CERTIFICATE OF CORRECTION

Patent No. 4,790,533 Dated December 13, 1988

Inventor(s) Clarence H. Potthast, Sr.

It is certified that error appears in the above-identified patent and that said Letters Patent are hereby corrected as shown below:

Column 7, line 52, after "thereof", insert --, comprising--.

Signed and Sealed this

Twenty-fifth Day of April, 1989

*Attest:*

DONALD J. QUIGG

*Attesting Officer*

*Commissioner of Patents and Trademarks*